US006880273B2

(12) United States Patent
Lo

(10) Patent No.: US 6,880,273 B2
(45) Date of Patent: Apr. 19, 2005

(54) WATER PLUG FOR AN ORNAMENTAL WATER BALL

(76) Inventor: Shih-Yuan Lo, P.O. Box 96-405, Taipei 106 (TW)

( * ) Notice: Subject to any disclaimer, the term of this patent is extended or adjusted under 35 U.S.C. 154(b) by 443 days.

(21) Appl. No.: 10/059,036

(22) Filed: Jan. 30, 2002

(65) Prior Publication Data

US 2003/0140534 A1 Jul. 31, 2003

(51) Int. Cl.[7] ..... G09F 19/00

(52) U.S. Cl. ..... 40/406; 40/410; 40/409; 446/267; 215/271

(58) Field of Search ..... 40/406, 409, 410, 40/411, 412, 422, 439; 446/267; 220/801, DIG. 19; 215/270, 271, 358

(56) References Cited

U.S. PATENT DOCUMENTS 5,775,529 A * 7/1998 Lo ..... 215/270
5,967,088 A * 10/1999 Lin ..... 119/269
6,036,571 A * 3/2000 Chang ..... 446/153
6,061,937 A * 5/2000 Meng ..... 40/409
6,540,099 B1 * 4/2003 Lu ..... 220/801
6,564,483 B1 * 5/2003 Hsu ..... 40/409
6,622,407 B1 * 9/2003 Liang ..... 40/406

* cited by examiner

*Primary Examiner*—Gary C. Hoge
(74) *Attorney, Agent, or Firm*—Troxell Law Office, PLLC

(57) ABSTRACT

A water plug for an ornamental water ball to prevent from leak upon the water being frozen into ice; the water ball has a neck part mounted with a water plug; the water plug includes a flat plate and a buffer cylinder; the buffer cylinder has a round cylinder extended down from the center of the flat plate; the inside of the round cylinder is furnished with a semi-spherical membrane extended upwards; the water filled in the glass balls subject to being frozen into ice in winter; in that case, the ice therein would distend to need more space, and then the buffer space furnished in the buffer cylinder will meet the requirement so as to prevent the water ball from having water leak.

3 Claims, 5 Drawing Sheets

WATER PLUG FOR AN ORNAMENTAL WATER BALL

BACKGROUND OF THE INVENTION

1. Field of the Invention

This invention relates to an ornamental water ball, and particularly to an ornamental water ball with a seal water plug on the bottom of the water ball to meet a requirement upon the water freezing.

2. Description of the Prior Art

In the conventional ornamental water ball, the bottom of the glass ball is furnished with a neck part, which is mounted with a positioning ring and a seal plug; then, all of them are assembled and mounted in water; the round edge of the seal plug is mounted with a positioning ring and a salient ring, which are then mounted to the neck part of the glass ball; in that case, the water in the glass ball is isolated from the atmosphere. In the water ball, the neck part of the glass ball is mounted in a round hole above an ornamental body by using a silicone as a seal and glue. The bottom of the ornamental body is usually mounted with a music device so as to have the water ball provided with an ornamental function and a music upon a spring motor being wound.

Conventionally, all parts of the glass ball and the water plug are put in water before being assembled so as to prevent air from being left in the glass ball; therefore, there will be no bubbles left on the water plug and the ornament glued in place. After the neck part of the glass ball and the water plug are assembled together, no leak would take place because of the resilience of the water plug, and also no air chamber exists in the glass ball; however, the density of water would change upon the ambient temperature varying during summer or winter time, i.e., the water may contract or distend; in that case the inner pressure of the glass ball will vary as a result of the contraction or distension of water. If the contraction or distension pressure thereof is greater than the seal strength between the glass ball and the water plug, the glass ball will have a leak of water or suck air therein; then, the glass ball will have an air chamber.

In the conventional ornamental water ball, the flat plate on the water plug is furnished with several grooves so as to provide a buffer function of distension; the grooves are made of a thinner material so as to provide a flexible change with the water therein during contracting or distending synchronously in summer or winter; however, such grooves can only provide a limited distension, and they can only improve the problem of a conventional water ball without furnished a complete improvement as a whole.

SUMMARY OF THE INVENTION

The prime object of the present invention is to provide a water plug for an ornamental glass ball, in which the water plug is mounted in the neck part of the glass ball; the top of the water plug has a flat plate, of which the center is furnished with a buffer cylinder extended downwards to form into a round cylinder, The bottom of the round cylinder is furnished with a semispherical membrane extended upwards so as to provide a space for ice; which is formed with water in the glass ball during winter; the semi-spherical membrane can extend downwards to some extent so as to prevent the water in the glass ball from leaking, or to prevent air from entering the glass ball.

Another object of the present invention is to provide a water plug for an ornamental glass ball, in which the flat plate of the water plug has a salient surface furnished with symmetrical grooves, which can provide a communication groove between the inner surface of the buffer cylinder and the space in the glass ball upon an ornament being glued to the salient surface of the water plug.

Still another object of the present invention is to provide a water plug for an ornamental glass ball, in which the center of the water plug is furnished with a buffer cylinder having a round cylinder extended downwards; the surface height of the round cylinder is able to vary with the distension of water in the glass ball upon being frozen into ice; the buffer cylinder is furnished with a semi-spherical buffer space to provide a distension space required by ice in the glass ball.

A further object of the present invention is to provide a water plug for an ornamental glass ball, in which the center of the water plug has a cylinder with a semi-spherical membrane to extend upwards; when the glass ball is filled with water, the semi-spherical membrane is still in semi-spherical shape without being affected by the pressure of water therein; when water in the glass ball is frozen into ice to have a distend cubic content, the membrane will be pushed downwards into the buffer cylinder, and the membrane might be pushed downwards to an extent below bottom of the round cylinder so as to provide a maximum buffer space for ice distension.

DETAILED DESCRIPTION OF THE PREFERRED EMBODIMENT

Figure 1:
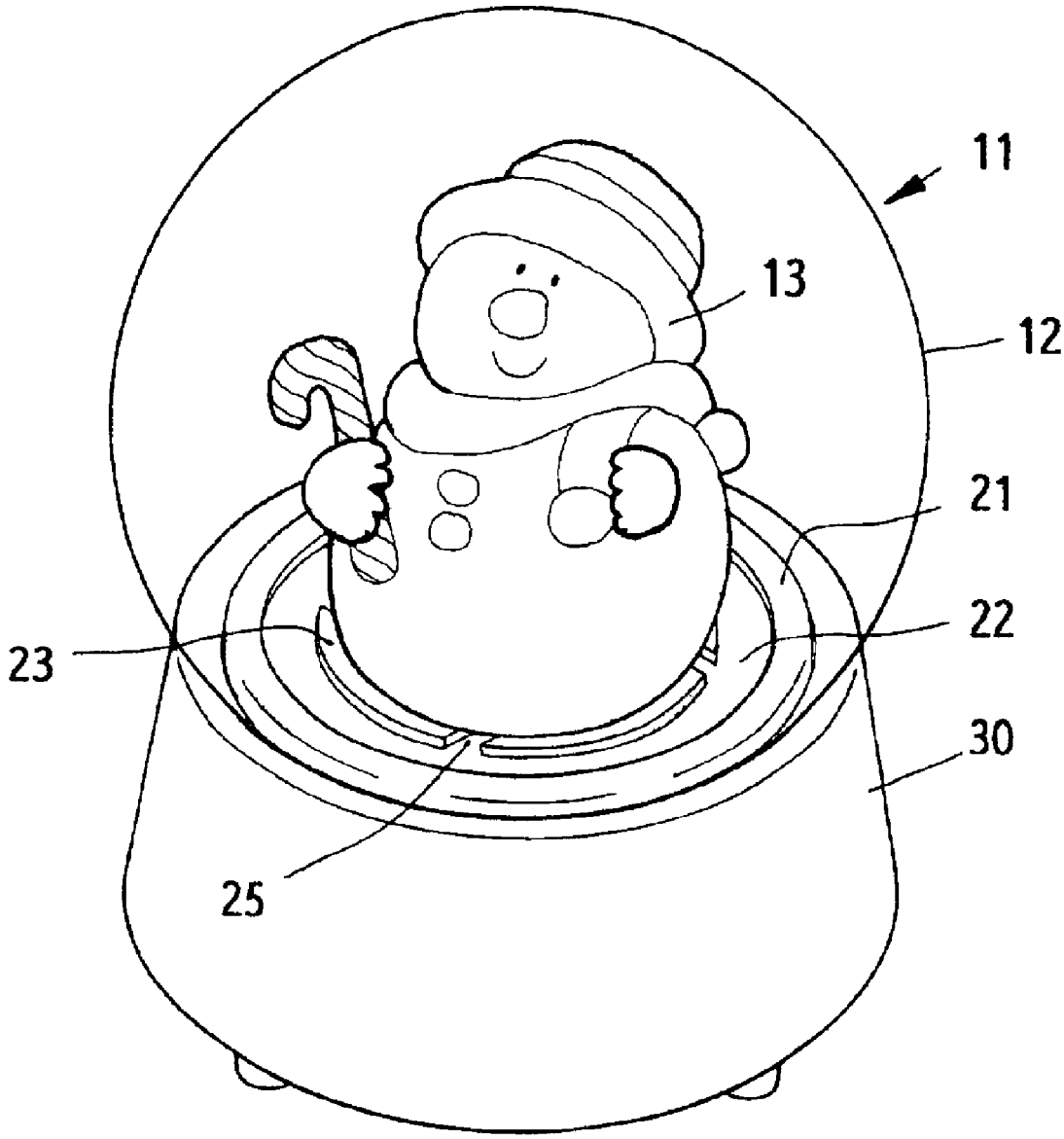
FIG. 1 is a perspective view of the present invention, showing the outer shape of a water ball.
Figure 2:
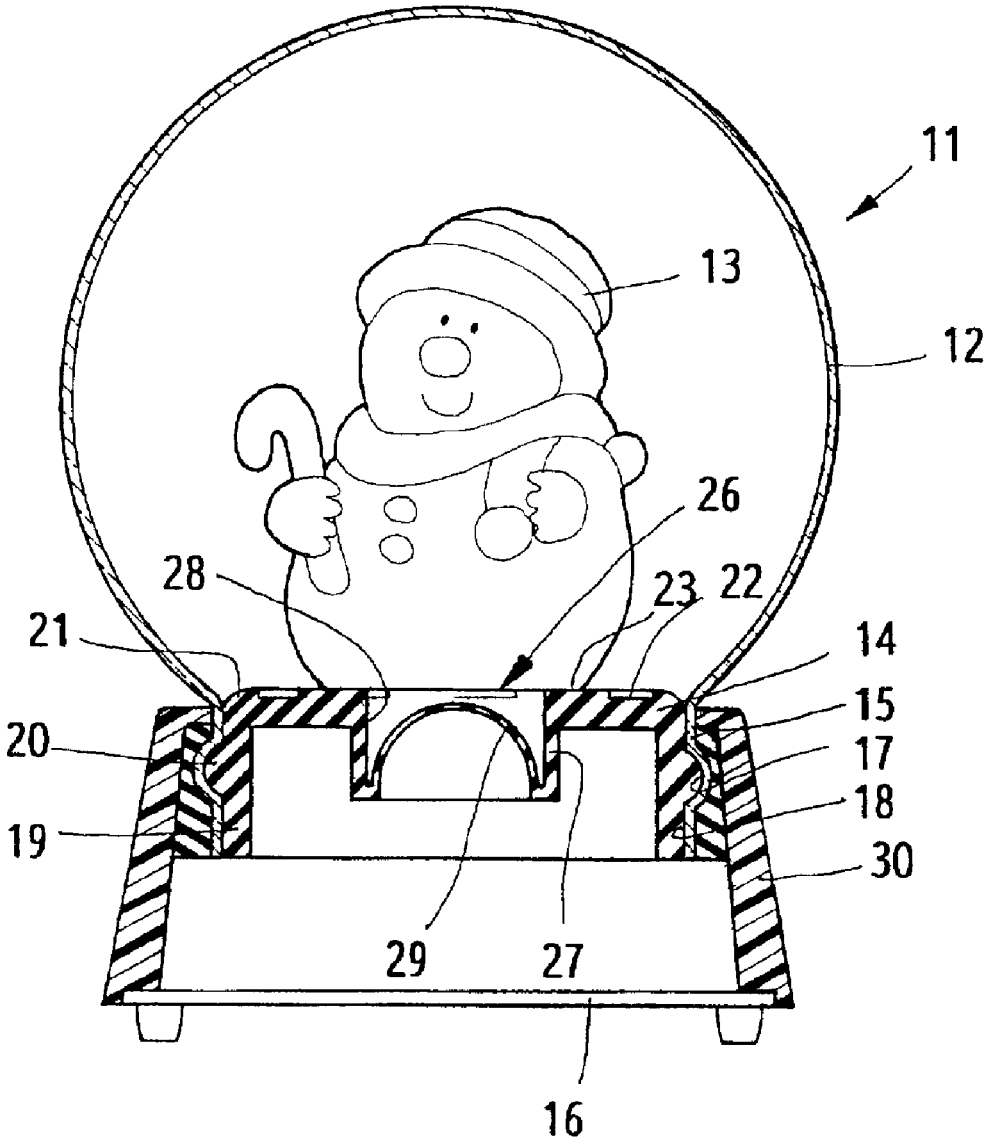
FIG. 2 is a sectional view of the present invention, showing the assembled relation between the water plug and the water ball.
Figure 3:
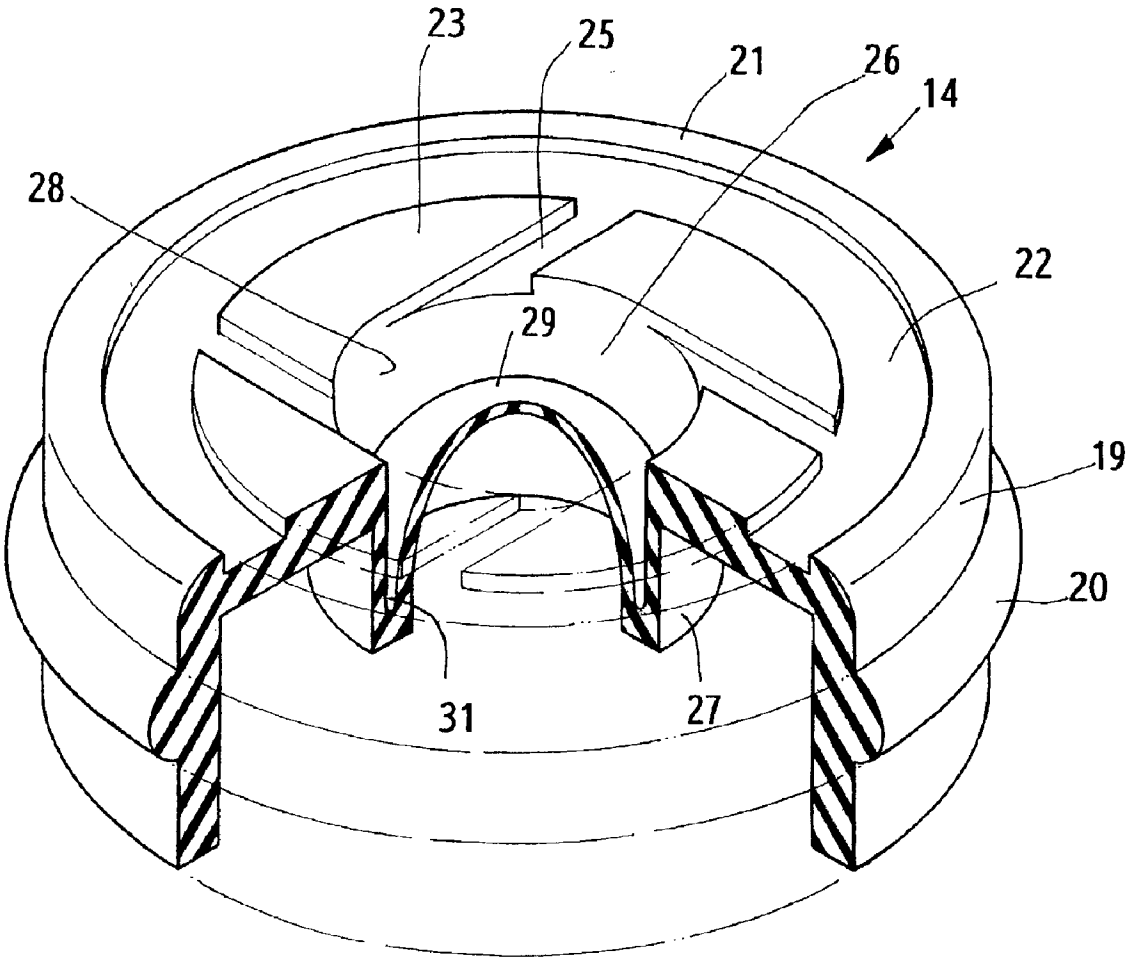
FIG. 3 is a sectional view of the present invention, showing the structure of the water plug.
Figure 4:
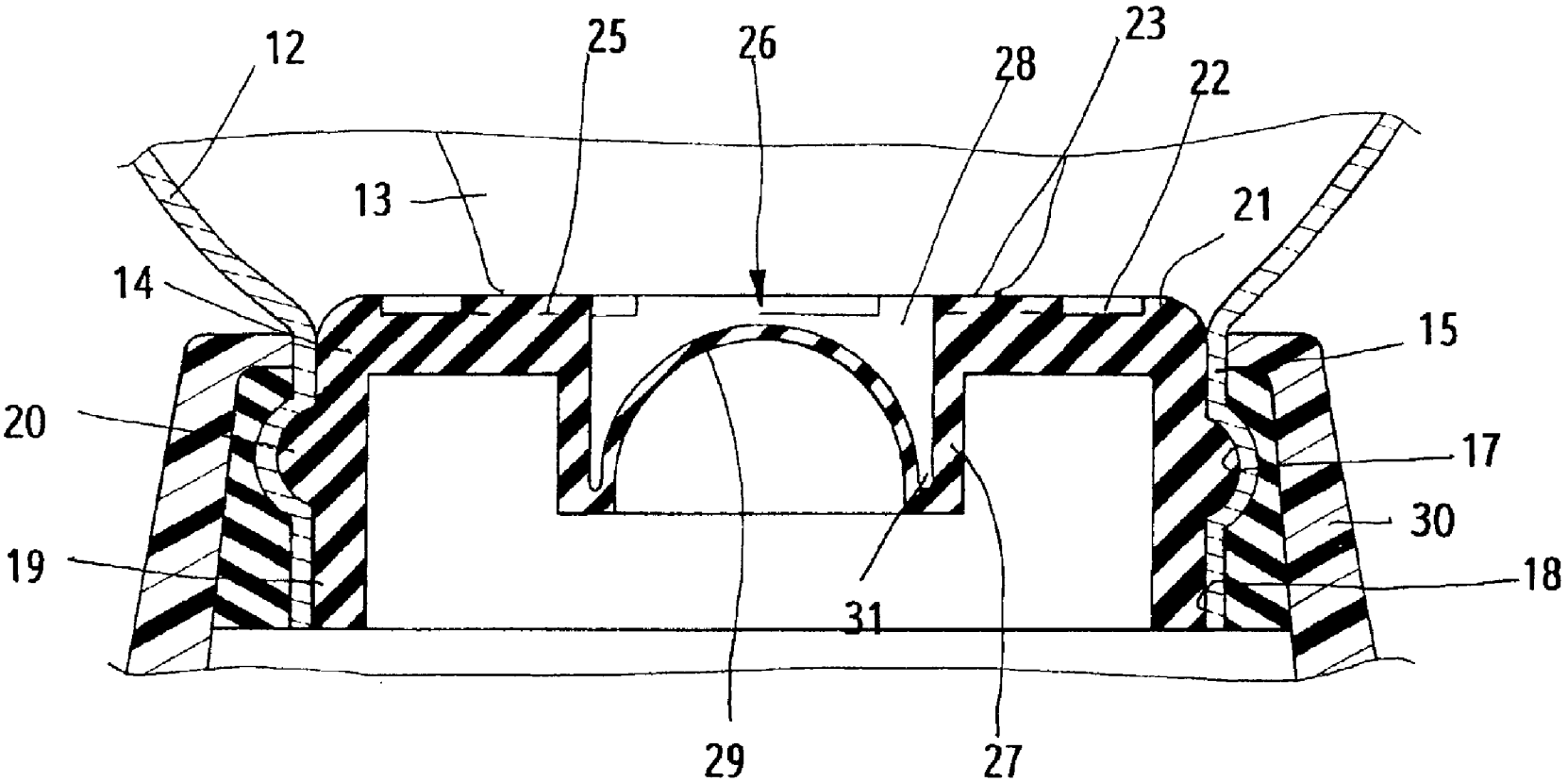
FIG. 4 is a sectional view of the present invention, showing the structure upon the water plug mounted around the neck part of the glass ball.

This invention relates to a water plug for an ornamental water ball; as shown in FIGS. 1 and 2, the ornamental water ball 11 includes a glass ball 12 filled with water. The neck part 15 of the glass ball 12 has a water plug 14 as a seal. The outer edge thereof is mounted in the round hole of the body portion 30. The flat surface of the water plug 14 in the glass ball 12 is glued with an ornament 13, which can provide a lens effect after the glass ball 12 is filled with water so as to have the ornament 13 provide an enlarged effect. The ornament 13 in the glass ball 12 may be used as a house ornament. The central lower end of the water plug 14 in the neck portion 15 includes a buffer cylinder 26, of which the inner surface 28 is furnished with a semi-spherical membrane 29 so as to provide a distended space upon the water in the water ball 11 being frozen during cold winter. As soon as the ice is melted, the semi-spherical membrane 29 will restore to its original shape.

As shown in FIGS. 1 to 5, the water plug 14 mounted on the neck part 15 of the glass ball 12 is a resilient and seal member made of rubber or plastics. The water plug 14 has a ring plate 19 with a size to fit with the inner surface of the neck part 15 of the glass ball 12 so as to be in hermetic contact with the inner surface of the neck part 15. The neck part 15 of the glass ball 12 is furnished with a concave ring 17 to be mated with a salient ring 20 of the ring plate 19. After the water plug 14 is mounted to the neck part 15 of the glass ball 12, the water plug 14 will be in close contact with the inner surface of the neck part 15 hermetically without leak and loosening.

The top of the water plug 14 in the neck part 15 has a flat plate 22 above the ring plate 19; the ring plate 19 has a round surface 21 which is above the flat plate 22. The center of the flat plate 22 is furnished with a cylindrical buffer cylinder 26 extended down-wards; the buffer cylinder 26 includes a round cylinder 27 and a semi-spherical membrane 29; the round cylinder 27 extends downwards from the center of the flat plate 22, and it is used as a support member of the membrane 29. The thickness of the round cylinder 27 is not important; the inner surface 28 of the round cylinder 27 is used for connecting the semi-spherical membrane 29, and used as a buffer space upon water becoming ice to cause distension. As shown in the drawings, the buffer cylinder 26 in the center of the flat plate 22 is equal to about the size of the glass ball 12 for water ball 11 available in the market. After the water plug 14 with a buffer cylinder 26 is mounted in place, the buffer cylinder 26 will provide sufficient buffer space upon the water in the glass ball 12 becoming ice to cause a distension; in that case, the semi-spherical membrane 29 in the round cylinder 27 will provide that buffer space.

The buffer cylinder 26 in the center of the flat plate 22 of the water plug 14 extends downwards from the bottom of the round cylinder 27 so as to provide a round variable space 31; the semi-spherical membrane 29 extended upwards from the bottom of the round cylinder 27 has a height slightly lower than the flat plate 22. The thickness and strength of the membrane are so designed that the membrane 29 would not descend downwards upon the glass ball 12 being filled fully with water, but it can provide a distending space upon the water being frozen and distended, i.e., to provide a variable buffer space.

The lower bottom of the semi-spherical membrane 29 and the inner surface 28 are separated each other with a variable space. The semi-spherical membrane 29 has physical features of resisting a pressure and restoring to its previous shape; the membrane 29 is made of a resilient rubber; the cubic content of water in the glass ball 12 has little change under normal temperature, and therefore the pressure in the glass ball 12 also has little change; in that case, the resilience of the membrane 29 is able to withstand the minor change of the cubic content of water.

The water plug 14 includes a flat plate 22, of which the center has a buffer cylinder 26; the top surface of the buffer cylinder 26 has a salient surface 23 on the flat plate 22; the salient surface 23 is furnished with symmetrical grooves 25 so as to furnish communication between the flat plate 22 and the buffer cylinder 26. The salient surface 23 is used for gluing an ornament 13; when an ornament 13 is glued in place, the cylindrical surface of the grooves 25 will be covered, but the water in the glass ball 12 still can flow freely through the grooves 25.

Before the water plug 14 and the glass ball 12 are assembled together, an ornament 13 should be glued to the salient surface 23; then, the inner surface 28 in the center of the salient surface 23 will be covered with the ornament 13, but the inner surface 28 can still be in communication with the outside through the grooves 25.

When the water plug 14 and the glass ball 12 are assembled, both the water plug 14 and the glass ball 12 are put in water so as to have the water plug 14 and the ornament not attached with any bubble; the water plug 14 glued with ornament 13 is put in the glass ball 12 through the neck part 15; then, the ring plate 19 and the salient ring 20 of the water plug 14 will be mated together hermetically with the cylindrical hole 18 and the concave ring 17 of the neck part 15 of the glass ball 12. The glass ball 12 is filled fully with water without having bubbles. After the neck part 15 of the glass ball 12 is mounted and glued into the body portion 30 with an ornament 13 to provide a decorative function.

After the glass ball 12 and the water plug 14 are assembled together under normal temperature, the glass ball 12 is filled fully with water in a closed space; the gravity of the water would not affect the pressure inside the glass ball 12 because of the thickness of the buffer cylinder 26 and the supporting force of the semi-spherical membrane 29; the membrane 29 of the buffer cylinder 26 in the water plug 14 perhaps have very little change.

Figure 5:
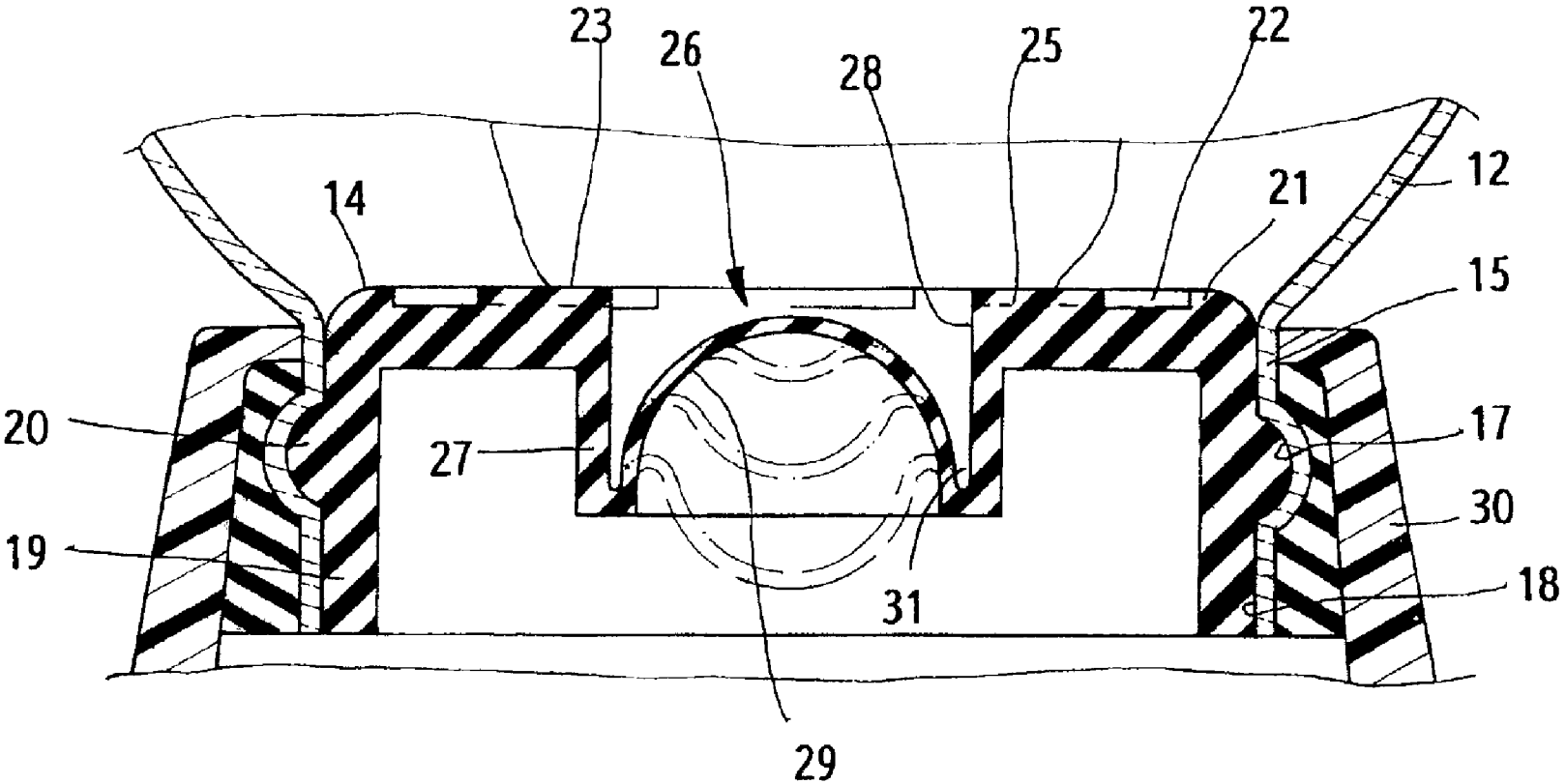
FIG. 5 is a sectional view of the present invention, showing the water plug being deformed upon water in the glass ball being frozen.

If the water ball 11 filled with water is put outdoors in the winter, the water in the glass ball 12 will become ice, which will distend considerably. As shown in FIG. 5, the semi-spherical membrane 29 in the inner surface 28 of the buffer cylinder 26 will move downwards to provide a buffer space upon the water being frozen into ice, i.e., to provide a buffer space of distension; in that case, the hermetical contact between the neck part 15 of the glass ball 12 and the ring plate 19 of the water plug 14 would not be demolished; then, after the ice is melted into water, air would not enter the glass ball 12 through the connection surface between the ring plate 19 of the water plug 14 and the neck part 15 of the glass ball 12.

The ice in the water ball 11 will be melted into water upon the ambient temperature rising to the normal temperature; in that case, the semi-spherical membrane 29 in the buffer cylinder 26 will restore to its original shape as a result of the resilient force thereof without affecting the sealing condition between the water plug 14 and the neck part 15 of the glass ball 12 at all.

According to the description of the aforesaid embodiment, the present invention has completely disclosed the features and structure thereof; it is apparent that the present invention has provided with obvious improvement of the kind, and such improvement is never anticipated and achieved by any person in the field; therefore, the structure of the present invention is deemed unique.

What is claimed is:

1. A water plug for an ornamental water ball, and said water plug being hermetically mounted in a neck part of a glass ball; said water plug including a ring plate and a salient ring, which are sealed hermetically with a cylindrical hole and a concave ring of said neck part of said glass ball respectively; center of a flat plate on said water plug furnished with a buffer cylinder which includes:

a round cylinder extended down from said flat plate;

a membrane extended upwards; said membrane being a semi-spherical membrane, and extending from said round cylinder towards said glass ball; and a salient surface on said flat plate and slightly higher than said flat plate; said salient surface furnished with grooves being in communication with said flat plate and an inner surface of said round cylinder.

2. A water plug for an ornamental water ball as claimed in claim 1, wherein said membrane of said buffer cylinder is located in a center of said inner surface of said round cylinder so as to form into a variable space.

3. A water plug for an ornamental water ball as claimed in claim 1, wherein said membrane of said buffer cylinder is located in a center of said inner surface of said round cylinder; a top surface of said membrane being lower than said flat plate of said water plug.

* * * * *